US006991511B2

(12) United States Patent
Maggiore et al.

(10) Patent No.: US 6,991,511 B2
(45) Date of Patent: Jan. 31, 2006

(54) EXPRESSION-VARYING DEVICE

(75) Inventors: Albert P. Maggiore, Lancaster, NY (US); Toshinobu Ishii, Toda (JP); Kazutsugi Kanagawa, Toda (JP); Hideyasu Karasawa, Tsuchiura (JP)

(73) Assignee: Mattel Inc., El Segundo, CA (US)

( * ) Notice: Subject to any disclaimer, the term of this patent is extended or adjusted under 35 U.S.C. 154(b) by 483 days.

(21) Appl. No.: 09/771,919

(22) Filed: Jan. 30, 2001

(65) Prior Publication Data

US 2002/0019193 A1 Feb. 14, 2002

(30) Foreign Application Priority Data

Feb. 28, 2000 (JP) ..... 2000-052423

(51) Int. Cl.
*A63H 11/00* (2006.01)

(52) U.S. Cl. ..... 446/330; 446/337; 446/344

(58) Field of Classification Search ..... 446/337, 446/343, 344, 345, 348
See application file for complete search history.

(56) References Cited

U.S. PATENT DOCUMENTS

| | | | | |
|---|---|---|---|---|
| 440,706 | A | 11/1890 | Graeser | |
| 928,744 | A | 7/1909 | Fisher | |
| 1,490,185 | A | 4/1924 | Ross | |
| 1,764,330 | A | 6/1930 | Marx | |
| 1,779,439 | A * | 10/1930 | Marcus et al. | 446/344 |

(Continued)

FOREIGN PATENT DOCUMENTS

| | | | |
|---|---|---|---|
| DE | 29708466 U1 * | 7/1997 | |
| FR | 2 696 652 A1 | 4/1994 | |

(Continued)

OTHER PUBLICATIONS

"Eye Mechanisms", Internet: http://www.clevelandfx.com/crazylou/tutorials/eyemechs.htm, 2002.*

(Continued)

*Primary Examiner*—Derris H. Banks
*Assistant Examiner*—Urszula M Cegielnik
(74) *Attorney, Agent, or Firm*—Cooley Godward LLP

(57) ABSTRACT

An expression-varying device is disclosed. The device includes a supporting member that supports two eyeball bodies so that the eyeball bodies are free to pivot. The device also includes a connecting member that connects the two eyeball bodies, and that supports the eyeball bodies so that the eyeball bodies can pivot in synchronization in a side to side or left to right direction. The device includes a swinging mechanism that causes the connecting member to swing upward and downward and to the left and right. The swinging mechanism includes a disk in which a recessed groove is formed in a side surface of the disk and runs in a circumferential direction. The depth of the groove and distance of the groove from the center of the disk vary according to relative positions on the disk. The swinging mechanism includes a motor that causes the disk to rotate. An engaging shaft which engages with the recessed groove of the disk is formed on and protrudes from and to the side of the arm member. The arm member is driven by a driving member so that the tip end of the engaging shaft constantly contacts the bottom part of the recessed groove. The tip end of the arm member is caused to swing upward and downward and to the left and right in linkage with the recessed groove of the disk. Accordingly, the connecting member is caused to swing upward and downward and to the left and right, thus causing the two eyeball bodies to pivot so that various expressions are displayed.

31 Claims, 10 Drawing Sheets

U.S. PATENT DOCUMENTS

| | | | | | |
|---|---|---|---|---|---|
| 1,782,477 | A | | 11/1930 | Price | |
| 1,903,549 | A | * | 4/1933 | Manning | 446/344 |
| 1,995,537 | A | * | 3/1935 | Dunner | 446/344 |
| 2,641,866 | A | | 6/1953 | Schiller | |
| 2,818,678 | A | | 1/1958 | Lemelson | |
| 3,099,894 | A | | 8/1963 | Carroll | |
| 3,186,126 | A | | 6/1965 | Ostrander | |
| 3,210,887 | A | | 10/1965 | Glass et al. | |
| 3,236,006 | A | | 2/1966 | Carroll | |
| 3,264,778 | A | | 8/1966 | Ryan | |
| 3,293,795 | A | | 12/1966 | Ryan | |
| 3,331,463 | A | | 7/1967 | Kramer | |
| 3,364,618 | A | | 1/1968 | Ryan et al. | |
| 3,421,254 | A | | 1/1969 | Ryan et al. | |
| 3,685,200 | A | | 8/1972 | Noll | |
| 3,839,821 | A | * | 10/1974 | Forsman | 446/28 |
| 3,911,613 | A | | 10/1975 | Morrison et al. | |
| 3,912,694 | A | | 10/1975 | Chiappe et al. | |
| 4,005,545 | A | * | 2/1977 | Ptaszek et al. | 446/343 |
| 4,139,968 | A | | 2/1979 | Milner | |
| 4,177,589 | A | | 12/1979 | Villa | |
| 4,207,704 | A | | 6/1980 | Akiyama | |
| 4,224,759 | A | | 9/1980 | Saint-Pierre et al. | |
| 4,282,677 | A | | 8/1981 | Abe | |
| 4,294,033 | A | | 10/1981 | Terzian | |
| 4,389,811 | A | | 6/1983 | Iwaya et al. | |
| 4,402,158 | A | * | 9/1983 | Seki et al. | 446/198 |
| 4,451,911 | A | | 5/1984 | Klose et al. | |
| 4,484,408 | A | | 11/1984 | Fogarty et al. | |
| 4,516,951 | A | | 5/1985 | Saigo et al. | |
| 4,571,208 | A | | 2/1986 | Saigo et al. | |
| 4,575,347 | A | * | 3/1986 | Kitamura | 446/348 |
| 4,582,499 | A | | 4/1986 | Saigo et al. | |
| 4,642,710 | A | * | 2/1987 | Murtha et al. | 360/79 |
| 4,660,033 | A | | 4/1987 | Brandt | |
| 4,710,145 | A | | 12/1987 | Hall Vandis | |
| 4,767,374 | A | | 8/1988 | Yang | |
| 4,775,352 | A | * | 10/1988 | Curran et al. | 446/344 |
| 4,795,395 | A | | 1/1989 | Oishi et al. | |
| 4,805,328 | A | | 2/1989 | Mirahem | |
| 4,808,142 | A | | 2/1989 | Berliner | |
| 4,810,226 | A | | 3/1989 | Takahashi et al. | |
| 4,820,232 | A | | 4/1989 | Takahashi et al. | |
| 4,820,233 | A | | 4/1989 | Weiner | |
| 4,820,234 | A | * | 4/1989 | Isaf | 446/100 |
| 4,840,602 | A | | 6/1989 | Rose | |
| 4,843,497 | A | | 6/1989 | Leyden | |
| 4,850,930 | A | | 7/1989 | Sato et al. | |
| 4,857,030 | A | | 8/1989 | Rose | |
| 4,864,607 | A | | 9/1989 | Mitamura et al. | |
| 4,900,289 | A | * | 2/1990 | May et al. | 446/343 |
| 4,913,676 | A | | 4/1990 | Koguchi et al. | |
| 4,923,428 | A | | 5/1990 | Curran | |
| 4,944,708 | A | | 7/1990 | Kawabe | |
| 5,021,878 | A | * | 6/1991 | Lang | 901/1 |
| 5,037,345 | A | | 8/1991 | Nakayama | |
| 5,074,821 | A | | 12/1991 | McKeefery et al. | |
| 5,108,341 | A | | 4/1992 | DeSmet | |
| 5,141,464 | A | | 8/1992 | Stern et al. | |
| 5,142,803 | A | | 9/1992 | Lang | |
| 5,158,492 | A | | 10/1992 | Rudell et al. | |
| 5,181,877 | A | | 1/1993 | Perkitny | |
| 5,250,003 | A | | 10/1993 | Ferre | |
| 5,281,143 | A | | 1/1994 | Arad et al. | |
| 5,290,198 | A | | 3/1994 | Nakayama | |
| 5,316,516 | A | | 5/1994 | Saitoh | |
| 5,376,038 | A | | 12/1994 | Arad et al. | |
| 5,399,115 | A | * | 3/1995 | Arad et al. | 446/342 |
| 5,407,376 | A | * | 4/1995 | Avital et al. | 446/345 |
| 5,413,516 | A | | 5/1995 | Lam | |
| 5,493,185 | A | | 2/1996 | Mohr et al. | |
| 5,636,994 | A | | 6/1997 | Tong | |
| 5,647,787 | A | | 7/1997 | Raviv et al. | |
| 5,651,716 | A | | 7/1997 | Mowrer et al. | |
| 5,655,945 | A | | 8/1997 | Jani | |
| 5,700,178 | A | | 12/1997 | Cimerman et al. | |
| 5,746,602 | A | | 5/1998 | Kikinis | |
| 5,802,488 | A | | 9/1998 | Edatsune | |
| 5,816,886 | A | | 10/1998 | Cusolito | |
| 5,823,847 | A | | 10/1998 | Gellman | |
| 5,833,513 | A | | 11/1998 | Llorens | |
| 5,855,502 | A | * | 1/1999 | Truchsess | 446/343 |
| 5,870,842 | A | | 2/1999 | Ogden et al. | |
| 5,876,263 | A | | 3/1999 | DeCesare et al. | |
| 5,902,169 | A | * | 5/1999 | Yamakawa | 446/337 |
| 5,975,979 | A | | 11/1999 | Ferri Llorens | |
| 5,983,542 | A | | 11/1999 | Chen | |
| 6,012,961 | A | | 1/2000 | Sharpe, III et al. | |
| 6,017,261 | A | | 1/2000 | Wachtel | |
| 6,039,626 | A | | 3/2000 | Gerold et al. | |
| 6,042,450 | A | | 3/2000 | Leversedge et al. | |
| 6,053,798 | A | | 4/2000 | Tang | |
| 6,089,942 | A | | 7/2000 | Chan | |
| 6,149,490 | A | | 11/2000 | Hampton et al. | |
| 6,149,491 | A | | 11/2000 | Arad et al. | |
| 6,736,694 | B2 | | 5/2004 | Hornsby et al. | |

FOREIGN PATENT DOCUMENTS

| | | | | |
|---|---|---|---|---|
| GB | 2198363 | A | * | 6/1988 |
| GB | 2 221 401 | A | | 2/1990 |
| GB | 2 256 598 | A | | 12/1992 |
| JP | 402031786 | A | | 2/1990 |
| JP | 02065887 | A | * | 3/1990 |
| JP | 04180791 | A | * | 6/1992 |
| JP | 406142342 | A | | 5/1994 |
| JP | 06304339 | A | * | 11/1994 |
| JP | 406327842 | A | | 11/1994 |
| JP | 07213750 | A | * | 8/1995 |
| JP | 10137453 | A | * | 5/1998 |
| JP | 411076632 | A | | 3/1999 |
| JP | 11179061 | A | * | 7/1999 |
| WO | WO 96/03190 | A1 | | 2/1996 |
| WO | WO 97/41936 | A1 | | 11/1997 |
| WO | WO 00/45920 | A1 | | 8/2000 |

OTHER PUBLICATIONS

"I'm Sorry, Dave. I'm Afraid I Can't Roll Over.", Newsweek, Apr. 10, 2000 (p. 16).

"Ameri–Bear," Phonetica One, Inc., Nov. 1986 (1 page).

Leininger, Steven, "Heath's HERO–1 Robot" BYTE Publications Inc., Jan. 1983 (6 pages).

* cited by examiner

FIG. 9

| CURRENT POS | DESTINATION POS | AMOUNT OF ROTATION | DIRECTION OF ROTATION |
|---|---|---|---|
| POS 1 | POS 2 | 1 | F (FORWARD ROTATION) |
| | POS 3 | 2 | |
| | POS 4 | 3 | |
| | POS 5 | 3 | B (REVERSE ROTATION) |
| | POS 6 | 2 | |
| | POS 7 | 1 | |
| POS 2 | POS 3 | 1 | F (FORWARD ROTATION) |
| | POS 4 | 2 | |
| | POS 5 | 3 | |
| | POS 6 | 3 | B (REVERSE ROTATION) |
| | POS 7 | 2 | |
| | POS 1 | 1 | |
| POS 3 | POS 4 | 1 | F (FORWARD ROTATION) |
| | POS 5 | 2 | |
| | POS 6 | 3 | |
| | POS 7 | 3 | B (REVERSE ROTATION) |
| | POS 1 | 2 | |
| | POS 2 | 1 | |
| POS 4 | POS 5 | 1 | F (FORWARD ROTATION) |
| | POS 6 | 2 | |
| | POS 7 | 3 | |

EXPRESSION-VARYING DEVICE

The present application claims priority to Japanese Patent Application Tokugan 2000-52423, entitled "Action-Performing Toy," filed Feb. 28, 2000, the disclosure of which is incorporated herein by reference in its entirety.

TECHNICAL FIELD OF THE INVENTION

The invention relates to an expression-varying device which is installed in dolls and animal toys, etc., and which can produce various expressions by movement of eyes and eyebrows.

BACKGROUND OF THE INVENTION

In the past, movement of the eyes has been used to produce varying expressions in dolls and animal toys, etc. Various types of eye driving devices have been proposed and used in practical applications. A common type of driving device is a device in which eyeball bodies are shaft-supported so that the eyeball bodies can pivot upward and downward. In this device, weight members are installed on the back surfaces of the eyeball bodies, so that when the doll is stood upright, the pupils of the eyeball bodies appear at the front, thus expressing a state in which the eyes are open. When the doll is placed on its back, the eyeball bodies pivot so that the pupils are hidden, thus expressing a sleeping state.

Since the eye movements are simple in the case of the above-mentioned driving device, the variations in expressions are also simple and various expressions cannot be exhibited.

There is therefore a need to provide an expression-varying device that makes it possible to show various expressions easily.

SUMMARY OF THE INVENTION

The shortcomings of prior devices are overcome by the disclosed expression-varying device which includes a supporting member that supports two eyeball bodies so that the eyeball bodies are free to pivot. The device also includes a connecting member that connects the two eyeball bodies, and that supports the eyeball bodies so that the eyeball bodies can pivot in synchronization in a side to side or left to right direction. The device includes a drive, or swinging mechanism, that causes the connecting member to swing upward and downward and to the left and right. The swinging mechanism includes a disk in which a recessed groove is formed in a side surface of the disk and runs in a circumferential direction. The depth of the groove and distance of the groove from the center of the disk vary according to relative positions on the disk.

The swinging mechanism includes an arm member with a rear end that is supported so that the arm member is free to pivot, and a tip end that engages with the connecting member. The swinging mechanism includes a motor that causes the disk to rotate. An engaging pin, or shaft, that engages with the recessed groove of the disk is formed on and protrudes from and to the side of the arm member. The arm member is driven by a driving member so that the tip end of the engaging shaft constantly contacts the interior of the recessed groove. The tip end of the arm member is caused to swing upward and downward and to the left and right in linkage with the recessed groove of the disk. Accordingly, the connecting member is caused to swing upward and downward and to the left and right, thus causing the two eyeball bodies to pivot so that various expressions are displayed.

In one embodiment, the expression-varying device includes eyebrow bodies that can pivot upward and downward and that are mounted on the front surface of the doll, animal, etc. The device includes cranks on coupling or drive shafts to which the eyebrow bodies are coupled. The device also includes cams connected to a shaft which cause the cranks to swing. Accordingly, the pivoting movements of the eyebrow bodies are linked to the movements of the eyeball bodies.

In another embodiment, the expression-varying device includes a first detection device that detects the home position of the disk, a second detection device that detects the rotational position of the disk, and a controller that determines the position of the disk from the first detection device and second detection device. The controller also performs rotational control of the motor based on the detection results from the two detection devices. The rotational position of the disk can be recognized and the motor can be rotated or stopped accordingly.

The controller controls the forward and reverse rotation of the motor so that the desired rotational position of the rotating disk is reached from the current rotational position of the rotating disk in the shortest possible time. Thus, when the eyeball bodies are pivoted to a desired pivoting position from the current pivoting position, it is possible to quickly vary expressions by pivoting the eyeball bodies in the shortest possible time.

BRIEF DESCRIPTION OF THE DRAWINGS

FIG. 9 is a table illustrating the relationships between the various positions of the disk.

DETAILED DESCRIPTION OF THE INVENTION

An embodiment of the invention is discussed in detail below. While specific implementations are discussed, it should be understood that this is done for illustration purposes only. A person skilled in the relevant art will recognize that other components and configurations may be used without parting from the spirit and scope of the invention.

A feature of the invention is that the eyeball bodies pivot in synchronization upward and downward and to the left and right (i.e. multiple degrees of freedom axes). As a result, a more abundant selection of facial expressions can be shown than is possible in the case of an eyeball body driving mechanism that simply opens and closes the eyes.

Another feature of the invention is that eyebrow bodies can be caused to move in addition to the pivoting of the eyeball bodies. Facial expressions that cannot be expressed by the eyes alone can be generated more effectively and realistically.

Another feature of the invention is that the position of the disk can be recognized by two detection devices, and desired expressions can be arbitrarily generated using these two detection devices. In cases where the device of the invention is incorporated into a doll, etc., that outputs a voice, facial expressions suited to the voice that is output can easily be generated.

Another feature of the invention is that a change to desired expressions can be accomplished in a short time, so that the expression of unintended expressions can be minimized. The resulting movement of the eyes can be made more natural.

Figure 1:
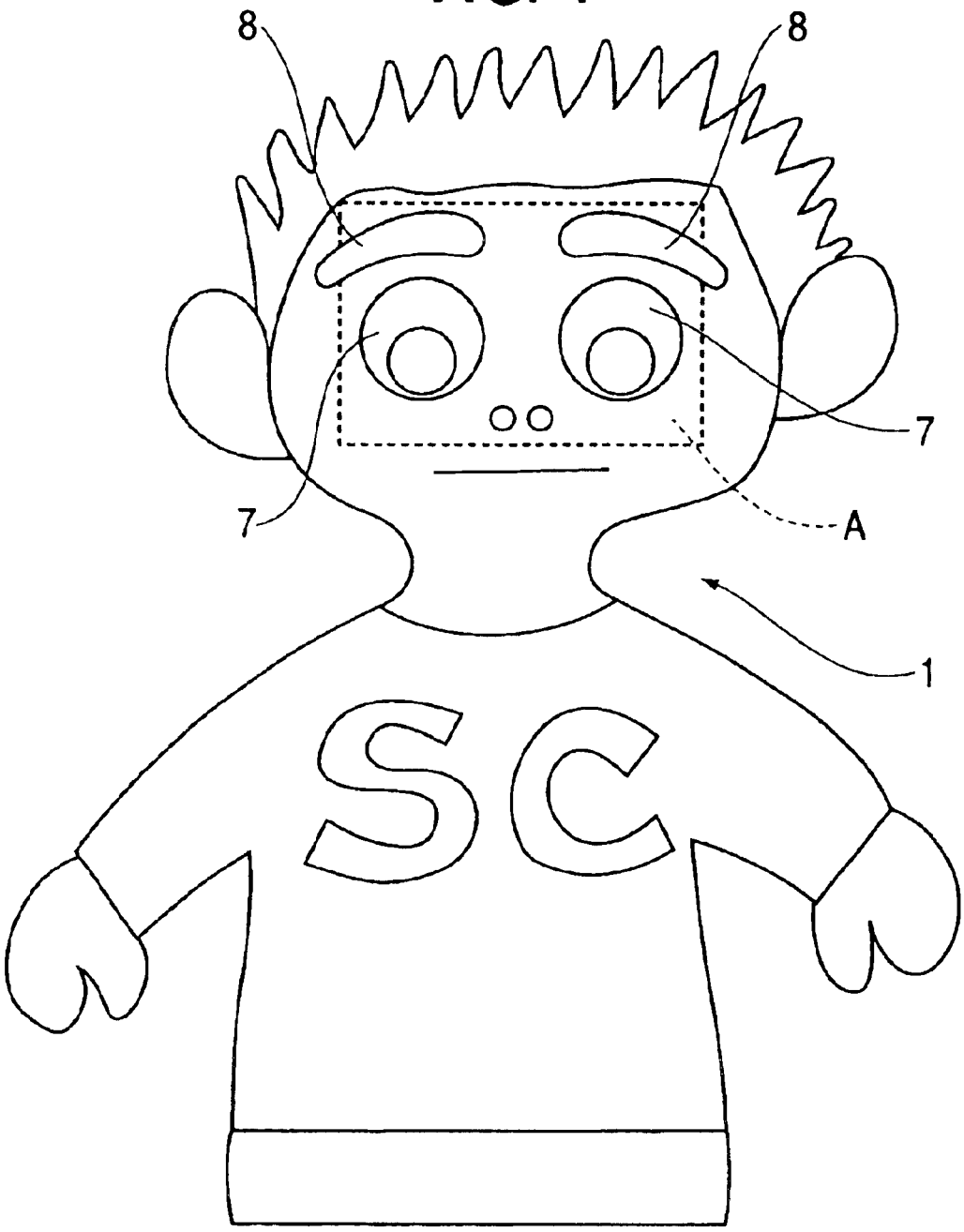
FIG. 1 is a front view of a doll equipped with an expression-varying device.
Figure 2:
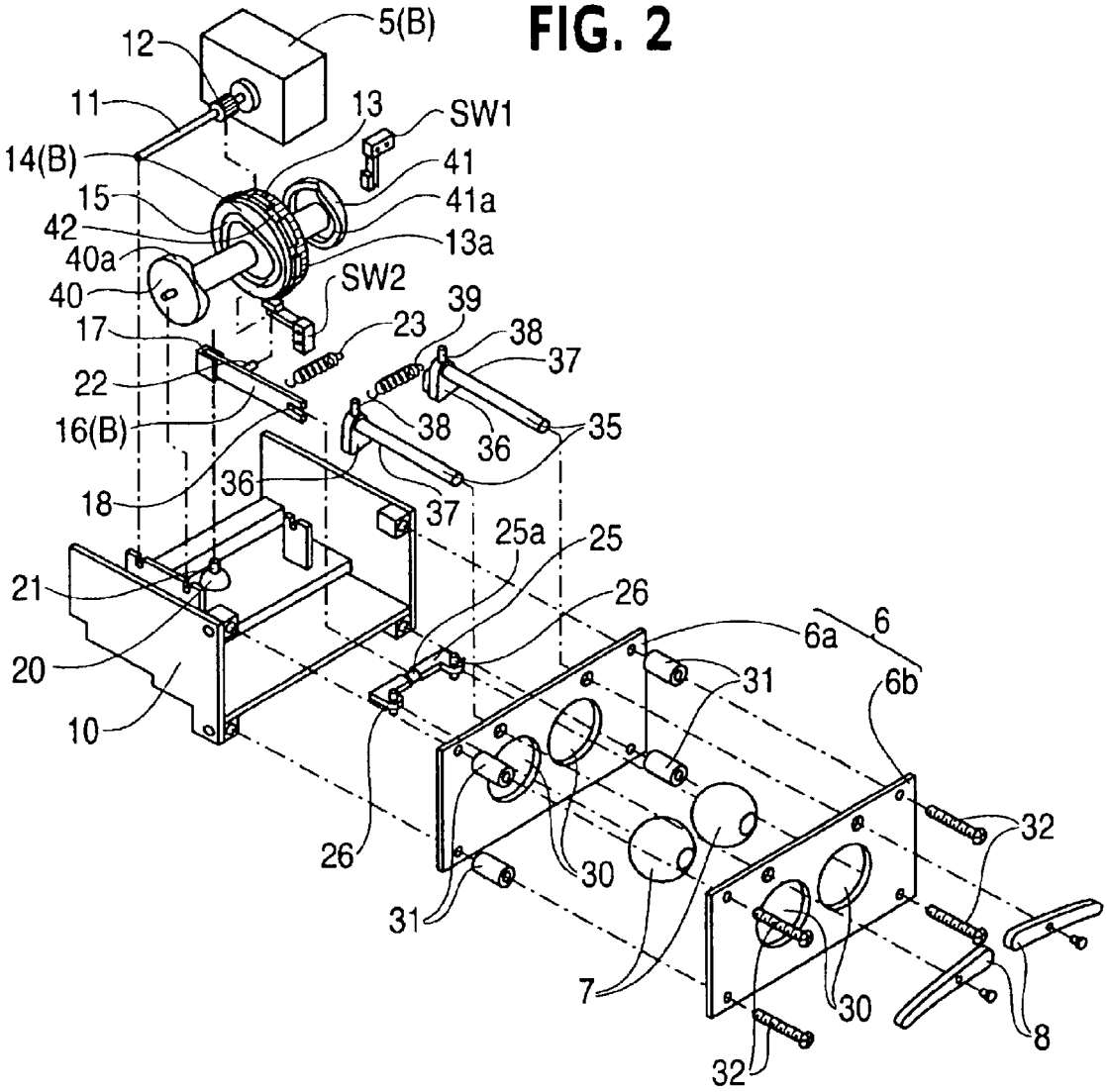
FIG. 2 is an exploded perspective view of the expression-varying device incorporated in the doll of FIG. 1.

FIG. 1 shows a doll toy that uses the expression-varying device A of the invention. FIG. 2 is an exploded perspective view of an embodiment of the expression-varying device A. In the illustrated embodiment shown in FIG. 2, the expression-varying device A is constructed so that movement is imparted to various facial elements of a toy. Two eyeball bodies 7, 7 supported by a supporting member, or part, 6 are caused to pivot upward and downward and to the left and right by a drive, or swinging mechanism, B which uses a motor 5 as a driving source. Eyebrow bodies 8, 8 disposed on the front surface of the supporting part 6 are caused to pivot upwardly and downwardly by the drive B. The expression-varying device A is installed in the head part of a toy body 1 such as a doll, animal, robot, etc.

The swinging mechanism B includes a motor 5, a disk 14 and an arm member 16. A pinion gear 12 is installed on the rotating or drive shaft 11 of the motor 5, which is fastened to a frame 10. The pinion gear 12 engages with a flat gear 13 that is mounted on shaft 12*a* as illustrated in FIG. 2. The disk 14 is formed coaxially with the flat gear 13 as an integral unit with the flat gear 13. A single recessed groove 15 is formed in the inside surface of the disk 14. Groove 15 runs in the circumferential direction.

Figure 3A:
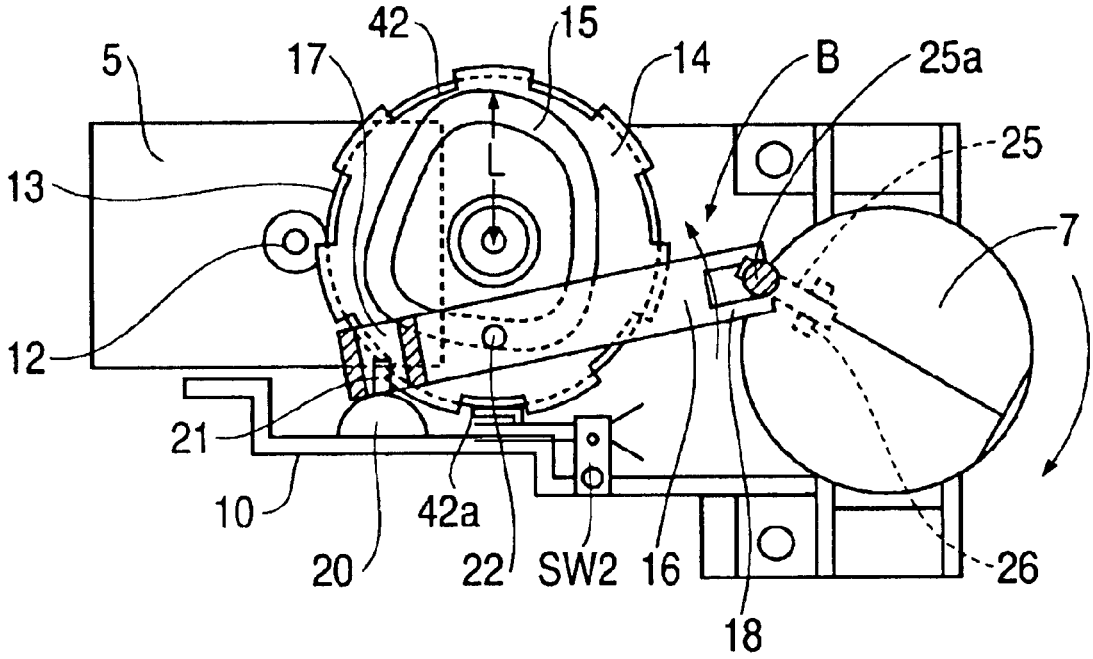
FIGS. 3(*a*) and (*b*) are cross-sectional views of the expression-varying device of FIG. 2.
Figure 3B:
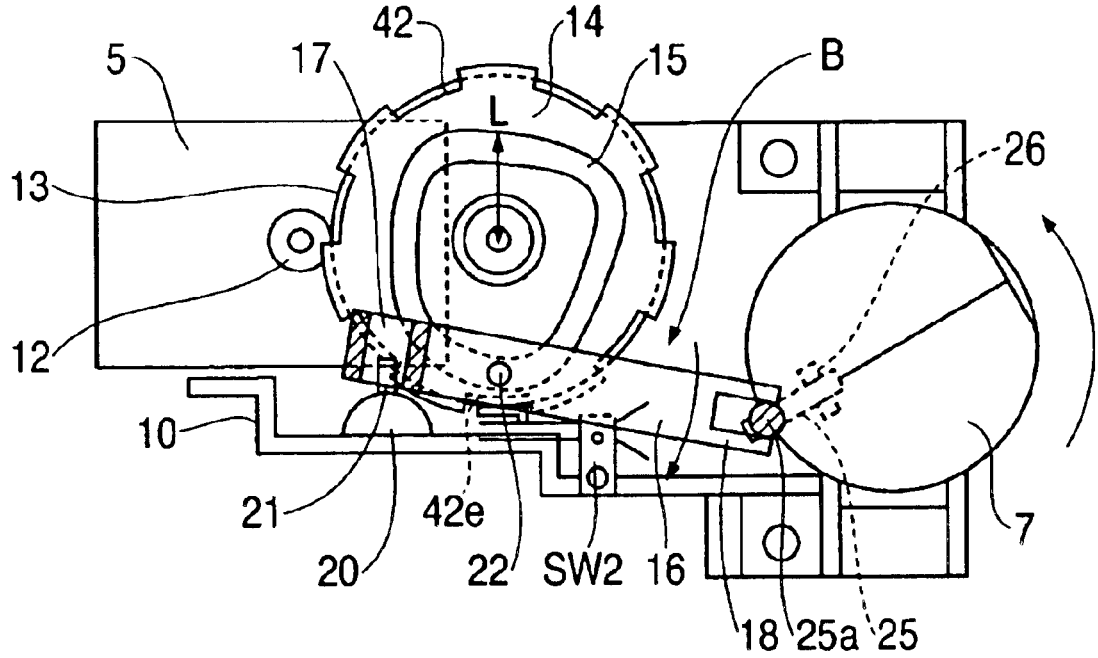

As is shown in FIG. 3(*a*), the recessed groove 15 is formed along a meandering path so that the distance L of the groove 15 from the center of the disk 14 varies from position to position. The recessed groove 15 is formed so that the depth D of the recessed groove 15 continuously varies according to the position (see FIG. 7).

In the illustrated embodiment, the arm member 16 is disposed on the inside of disk 14. An engaging hole 17 is formed in the vertical direction in the rear end of the arm member 16. A supporting shaft 21 protrudes upward from the upper end of a hemispherical base 20 that protrudes from the upper surface of the frame 10. The supporting shaft 21 passes through the engaging hole 17, and the arm member 16 is arranged so that the tip end portion of the arm member 16 can swing upwardly and downwardly and to the left and right about the supporting shaft 21.

A C-shaped gripping part 18 is formed on the tip end of the arm member 16. A connecting member 25 that connects the eyeball bodies 7 is gripped by gripping part 18 so that the connecting member 25 can pivot.

An engaging pin, or shaft, 22 is formed on the arm member 16. The engaging shaft 22 protrudes from the side portion of the arm member 16 toward the disk 14. The tip end of the engaging shaft 22 is inserted into the recessed groove 15 formed in the disk 14. The arm member 16 is constantly driven toward the disk 14 by a spring 23, so that the tip end of the engaging shaft 22 is constantly in contact with the inner surface of the recessed groove 15.

Accordingly, when the disk 14 rotates, the engaging shaft 22, whose tip end is inserted into the recessed groove 15, is caused to move upward and downward by the side walls of the recessed groove 15 as shown in FIGS. 3(*a*) and 3(*b*). As a result, the arm member 16 swings upwardly and downwardly about the supporting shaft 21.

Figure 4A:
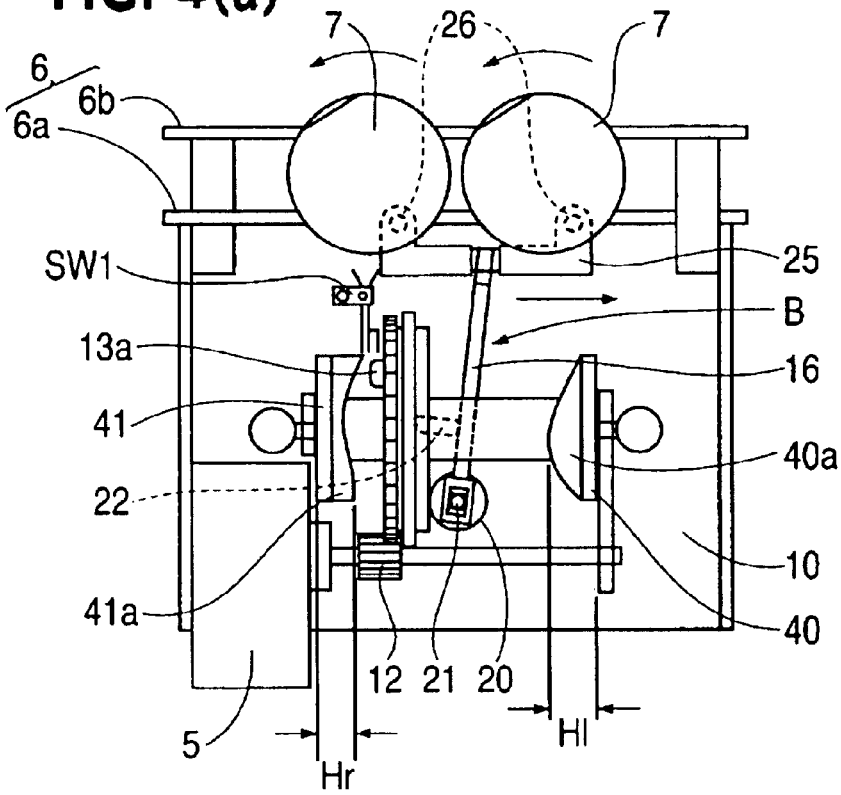
FIGS. 4(*a*) and (*b*) are plan views of the expression-varying device of FIG. 2.
Figure 4B:
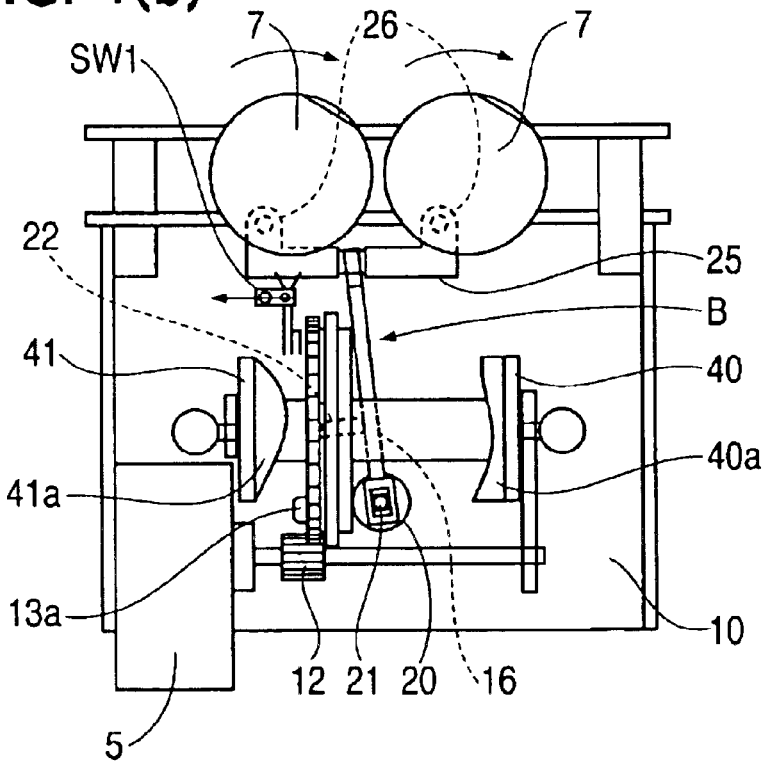

Since the engaging shaft 22 is driven by the spring 23 so that the tip end of the engaging shaft 22 is constantly in contact with the inner surface of the recessed groove 15, the arm member 16 is caused to pivot to the right against the spring 23 as shown in FIG. 4(*a*) where the recessed groove 15 is shallow, and is pulled by the spring 23 and caused to pivot to the left about the supporting shaft 21 as shown in FIG. 4(*b*) where the recessed groove 15 is deep. Accordingly, the arm member 16 swings to the left and right about the supporting shaft 21. As a result, the arm member 16 swings upward and downward and to the left and right in conformity with the shape of the recessed groove 15.

In the illustrated embodiment, the connecting member 25 that connects the two eyeball bodies 7, 7 is gripped by the gripping part 18 located at the tip end of the arm member 16 so that the connecting member 25 can pivot. The connecting member 25 is a member that is substantially C-shaped when viewed in a plan view. The center of the connecting member 25 is formed as a cylindrical neck part 25. Neck part 25*a* is gripped by the gripping part 18 so that the connecting member 25 can be caused to pivot upward and downward about the gripping part 18.

As shown in FIGS. 4(*a*) and 4(*b*), both ends of the connecting member 25 protrude forward. Engaging shafts 26 are formed to protrude upward and downward from the protruding parts of the connecting member 25. These engaging shafts 26 are loosely engaged with engaging holes 27 formed in the eyeball bodies 7 to enable the eyeball bodies 7 to pivot to the left and right about the engaging shafts 26.

Figure 5:
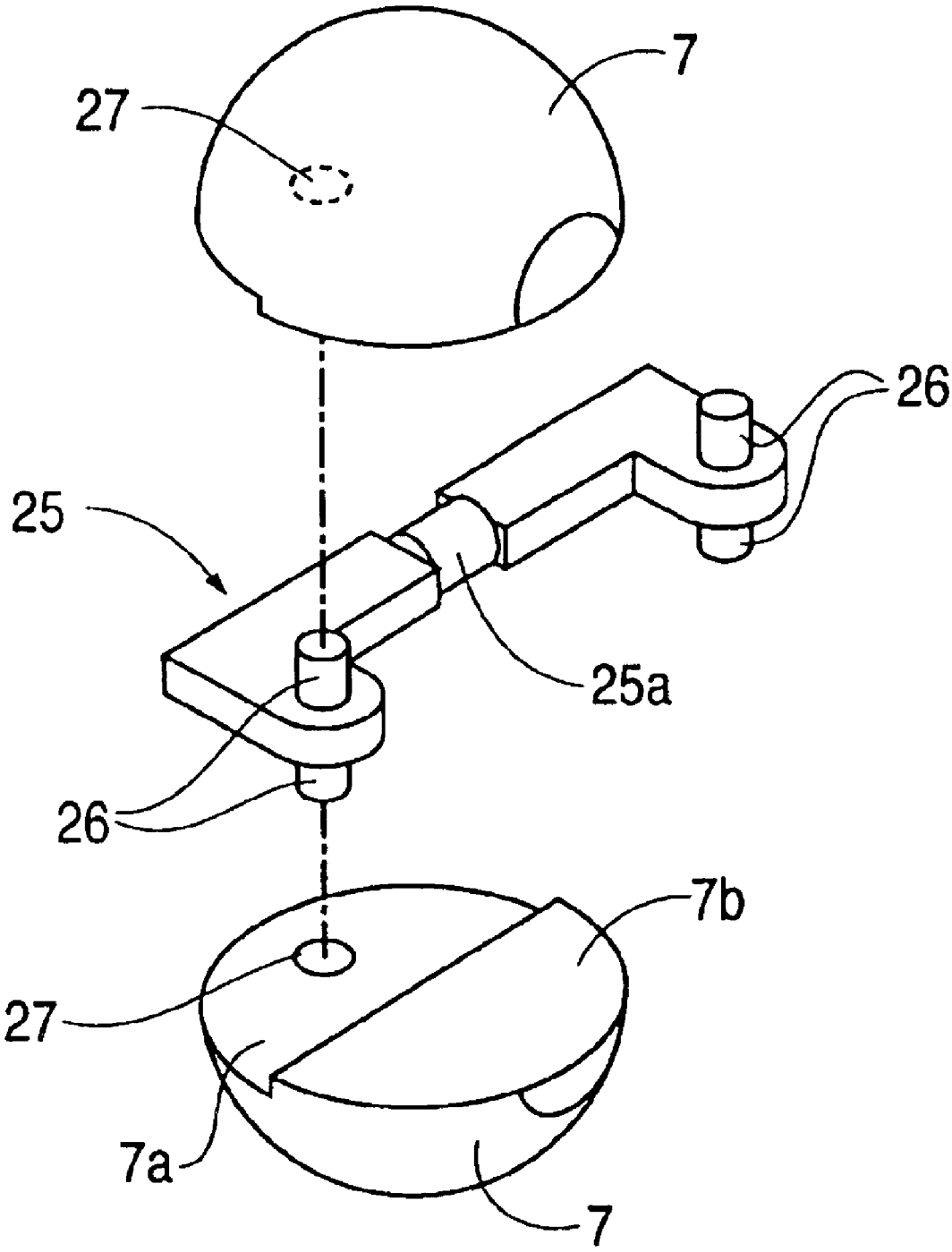
FIG. 5 is an exploded perspective view illustrating the relationship of the eyeball bodies and connecting member.

As shown in FIG. 5, the eyeball bodies 7 are split into two parts, i.e., upper and lower parts, and engaging holes 27 are formed in the split surfaces 7*a*. After the engaging shafts 26 of the connecting member 25 are inserted into the engaging holes 27, the joining surfaces 7*b* of the eyeball bodies 7 can be fastened together by an appropriate method such as bonding, etc.

In the illustrated embodiment, the eyeball bodies 7, 7 are supported so that they are free to pivot by a supporting part 6. As illustrated in FIG. 4(*a*), supporting part 6 includes two supporting plates 6*a* and 6*b*. Circular opening parts 30, each of which have a diameter that is slightly smaller than the diameter of the eyeball bodies 7, are respectively formed in the supporting plates 6*a* and 6*b*. The two supporting plates 6*a* and 6*b* are fastened to the frame 10 by screws 32 via tubular members 31. The length of the tubular members 31 is selected so that the eyeball bodies 7, 7 have space to pivot and are not fixed in place by the two supporting plates 6*a* and 6*b*.

In the illustrated embodiment, two eyebrow bodies 8, 8 are pivotally disposed on the upper portion of the front surface of supporting plate 6*b*. The eyebrow bodies 8, 8 are screw-fastened to the tip ends of coupling, or drive, shafts 35 that pass through the two supporting plates 6*a* and 6*b*. Cranks 36 which are substantially fan-shaped are formed on the rear ends of the drive shafts 35. Engaging shafts 37 are formed on the back surfaces of these cranks 36 so that the engaging shafts 37 protrude rearwardly.

Figure 6A:
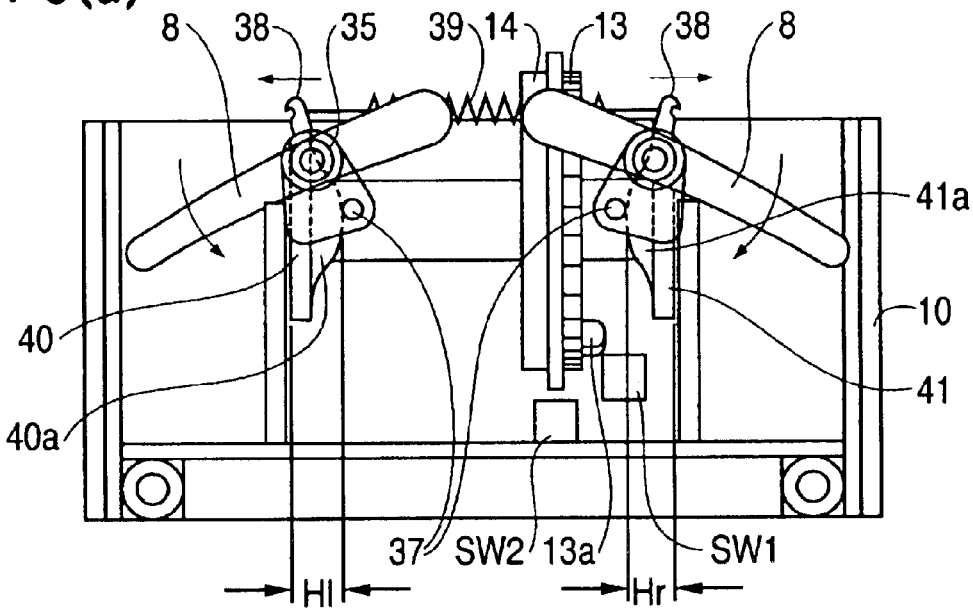
FIGS. 6(*a*) and (*b*) are front views showing the operation of the eyebrow bodies.
Figure 6B:
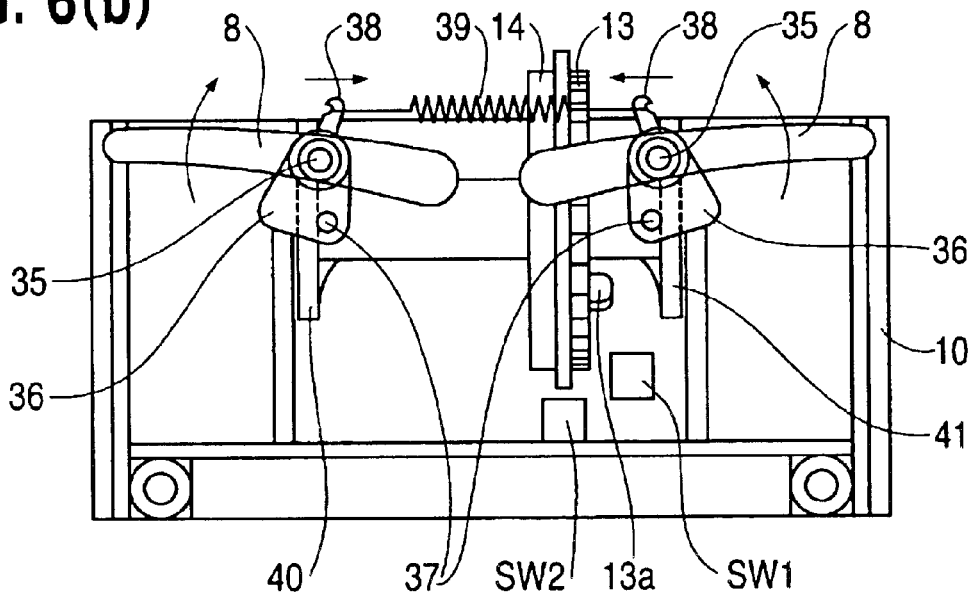

A spring 39 is attached to protruding hooks 38, 38 formed on the upper ends of the cranks 36, 36 so that the cranks 36, 36 both pivot outwardly. As illustrated in FIGS. 6(*a*) and 6(*b*), the engaging shafts 37 engage with circular plate-form cams 40 and 41 which are disposed at a specified spacing on both sides of the disk 14, and which are installed coaxially on the shaft with the disk 14. Wave-form surfaces 40*a* and 41*a* with projections and indentations are formed facing inwardly on the circumferential edges of the cams 40 and 41. The cranks 36, 36 are driven by spring 39 so that the engaging shafts 37, 37 are pressed against the cams 40 and 41. When the cams 40 and 41 rotate, the engaging shafts 37, 37 swing to the left and right along the surfaces 40*a* and 41*a*, so that the drive shafts 35, 35 pivot, thus causing the eyebrow bodies 8, 8 to pivot upward and downward as shown in FIGS. 6(*a*) and 6(*b*).

In the illustrated embodiment, a rotational position indicating part 42 is formed on the circumferential surface of the disk 14. As illustrated in FIGS. 3(*a*) and 3(*b*), the rotational position indicating part 42 includes seven recesses 42*a* through 42*g* formed at equal intervals in the circumferential surface of the disk 14. A second detection device which detects the rotational position indicating part 42 is installed on the frame 10. In this embodiment, the second detection device includes a leaf switch SW2. The system is arranged so that the recesses 42*a* through 42*g* can be detected as a result of the leaf switch SW2 being switched OFF. The ON/OFF state of this leaf switch SW2 can be recognized by the controller 45, which is described later.

In the illustrated embodiment, the rotational position indicating part 42 includes recesses, and the second detection device includes a leaf switch SW2. However, it can be appreciated that it would be possible to embed magnets at specified intervals in the circumferential surface the disk, and the presence or absence of these magnets could be detected by a leaf switch. Alternatively, reflective plates could be installed at specified intervals on the circumferential surface of a rotating disk, and the presence or absence of these reflective plates could be detected by a photo-sensor.

In the illustrated embodiment, a projection 13*a* is formed on the outside surface of the flat gear 13, and a first detection device that detects projection 13*a* is installed on the frame 10 (see FIGS. 4(*a*) and 4(*b*)). In this embodiment, the first detection device is a leaf switch SW1. Leaf switch SW1 is switched ON when it detects the projection 13*a*. When the leaf switch SW1 is switched ON, the controller 45 can recognize that the rotational position of the disk 14 is the home position.

In the invention, when the rotational position of the disk 14 is in the home position, the arm member 16 is pivoted upward to the maximum limit as shown in FIG. 3(*a*) so that the eyeball bodies 7 are pivoted downward to the maximum limit, thus expressing a state in which the eyes are closed.

Figure 7:
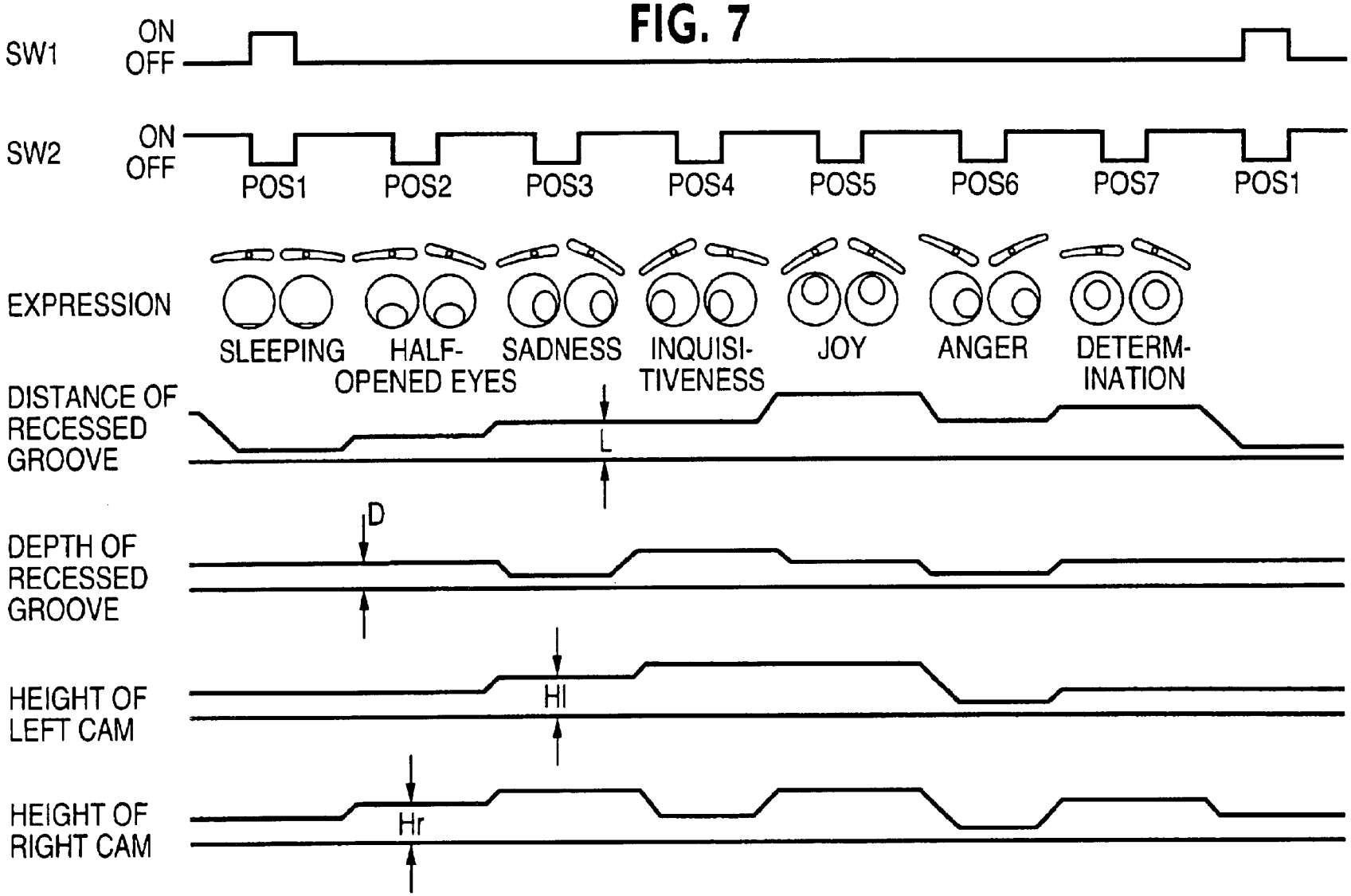
FIG. 7 illustrates a timetable showing the relationship between the detection devices and the expressions generated by the expression-varying device.

As shown in FIG. 7, the rotational position of the disk 14 when the motor 5 rotates so that the first detection device SW1 is switched ON and the second detection device SW2 detects the recess 42*a* is designated as the home position (POS1). The expression at POS1 represents a sleeping expression. Using the home position as a standard, the distance L of the recessed groove 15 of the disk 14 from the center of the disk 14, the depth of the groove D, and the heights Hl and Hr of the cam surfaces 40*a* and 41*a* of the cams 40 and 41 are set relative to the recesses 42*a* through 42*g* so that multiple different expressions can be produced.

For example, as shown in FIG. 7, the second rotational position (POS2) produces an expression of half-opened eyes, the third rotational position (POS3) produces a sad expression, the fourth rotational position (POS4) produces an inquisitive expression, the fifth rotational position (POS5) produces a joyous expression, the sixth rotational position (POS6) produces an angry expression, and the seventh rotational position (POS7) produces a determined expression.

Figure 8:
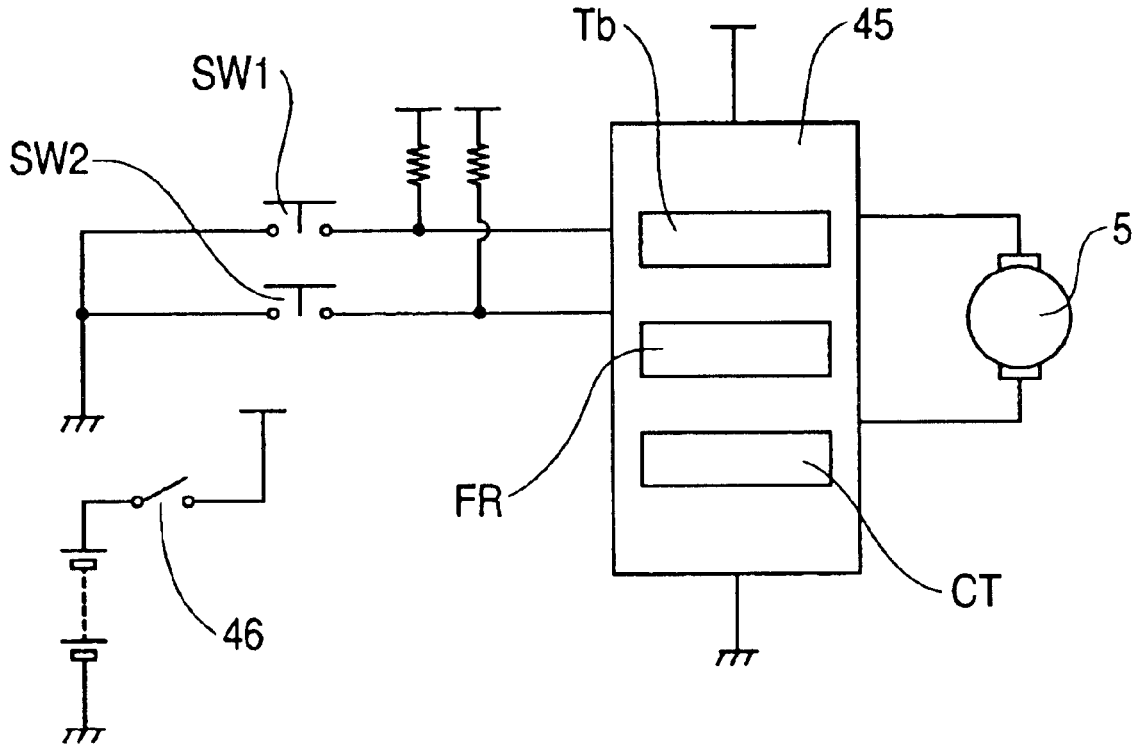
FIG. 8 is a block diagram illustrating some components of the expression-varying device.

FIG. 8 shows a block diagram of some components of the system. Controller 45 controls the rotation of the motor 5 in accordance with a control program stored in the memory and based on the detection results obtained by the two leaf switches SW1 and SW2.

When the power supply is switched ON, controller 45 causes the motor 5 to rotate. When it is determined that the rotational position of the disk 14 has reached the home position as a result of the leaf switch SW1 being switched ON, the motor 5 is stopped. When the rotational position of the disk 14 is in the home position, the distance of the recessed groove 15 from the center is at a minimum, and the depth of the recessed groove 15 is at an intermediate value. As a result, the pupils of the eyes are positioned downward and the eyeball bodies 7, 7 are pivoted to face forward, thus producing or expressing a state in which the eyes are closed (sleeping). In this case, the attachment position of the leaf switch SW2 is set so that the recess 42*a* (POS1) of the disk 14 is detected. The controller 45 recognizes the home position as a result of the leaf switch SWI being switched ON, and recognizes the rotational position of the disk 14 by counting the number of times that the leaf switch SW2 is switched OFF.

A position table Th is formed in the memory of the system. The position table Th defines the current rotational position of the disk 14, and also defines how far and in which direction (forward or reverse) the disk 14 must be rotated in order to stop the disk 14 in a given rotational position.

FIG. 9 shows an embodiment of the position table Th. In this example, the position table Th indicates when the current rotational position (current POS) is the second position (POS2) and the desired (destination) position is the fifth position (POS5), the motor 5 should be rotated in the forward direction (F direction) until the counter CT has counted the switching OFF of the leaf switch SW2 three times. Similarly, if the desired position is the first position (POS1), the motor should be rotated in the reverse direction (B direction) until the counter CT has counted the switching OFF of the leaf switch SW2 once.

Next, the operation of the expression-varying device in accordance with the invention will be described with reference to the flow chart shown in FIG. 10.

When the power supply switch 46 is switched ON, the motor 5 is caused to rotate (step STI). When the leaf switch SWI is switched ON (step ST2), it is determined that the disk 14 is positioned in the home position. Accordingly, a flag is set in POS1 of a flag register FR, the motor 5 is stopped (step ST3), and a start command is awaited (step ST4).

After a start command is received, the direction of rotation is determined and the amount of rotation is set in the counter CT with reference to the position table Th based on the current position and the destination position of the start command (step ST5). If the rotation is a forward rotation, the processing proceeds to the routine following step ST7. If the rotation is a reverse rotation, the processing proceeds to the routine following step ST11.

Figure 10:
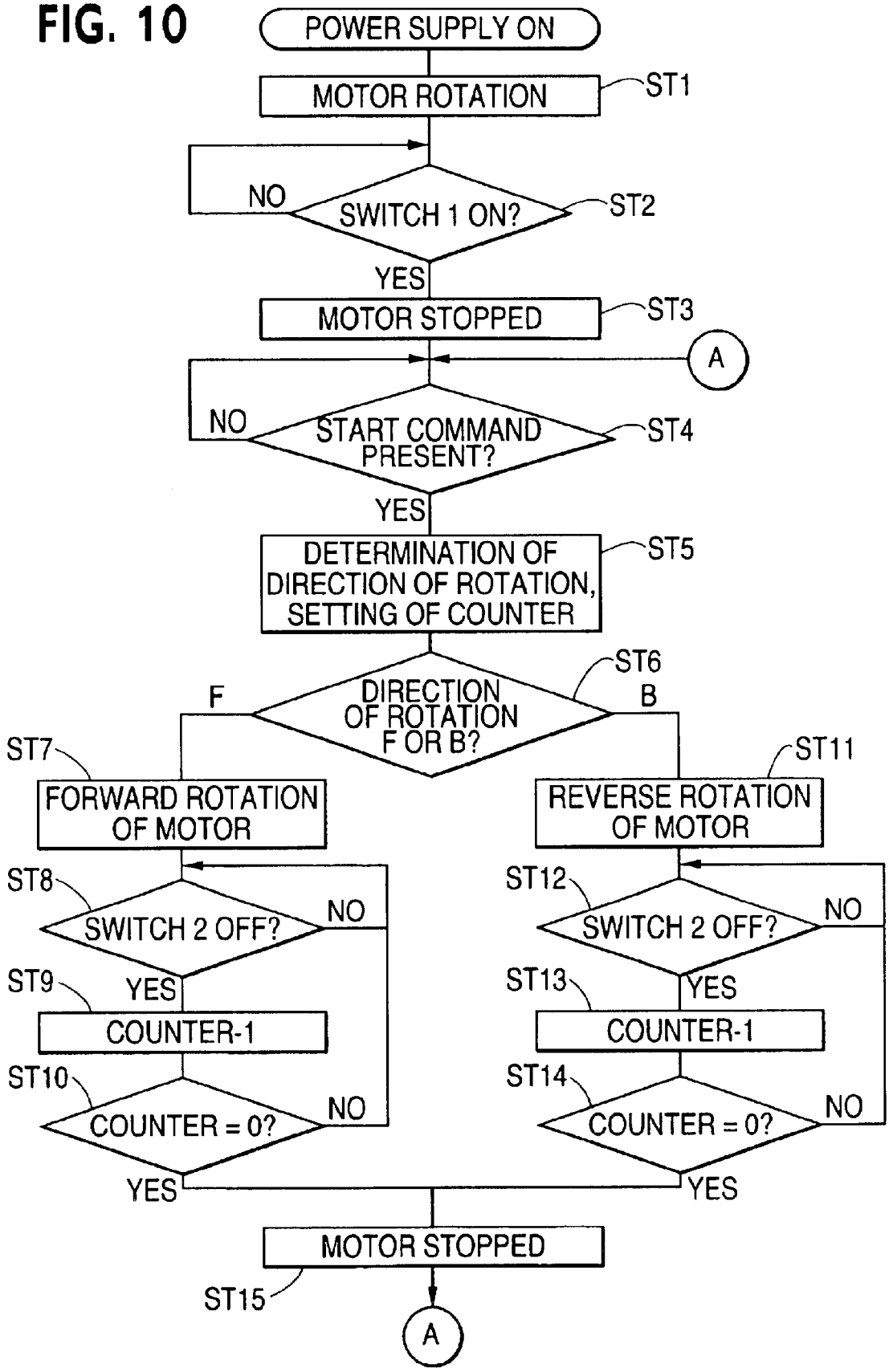
FIG. 10 is a flow chart that illustrates the operation of the expression-varying device in accordance with the invention.

As illustrated in FIG. 10, steps ST8, ST9, and ST10 correspond to steps ST12, ST13, and ST14, respectively. At steps ST8 and ST12, the switching OFF of the leaf switch SW2 is awaited, and when this switch is switched OFF, the counter CT performs a countdown as shown in steps ST9 and ST13. When the counter value reaches zero (steps ST10 and ST13), it is determined that the rotational position of the disk 14 has reaches the desired destination position. Accordingly, the operation proceeds to step ST15, and the motor 5 is stopped. A flag is set in the current position in the flag register FR, and the processing returns to step ST4 and waits for the next start command.

Thus, the rotational position of the disk 14 when the first detection device (leaf switch SW1) is switched ON is taken as the home position. With this home position as a standard, the current rotational position is read from the flag register FR, and the direction and amount of rotation of the motor 5 are controlled with reference to the position table Tb based on the current position and destination position (rotational positions). Accordingly, the disk 14 can always be rotated to the desired rotational position in the shortest possible time, so that expressions can be rapidly varied.

The recessed groove 15 and the cams 40 and 41 are formed so that the positions of the eyeball bodies 7 and eyebrow bodies 8 correspond to rotational positions of the rotating disk. As a result, the pivoting positions of the eyeball bodies 7 and pivoting positions of the eyebrow bodies 8 can be determined from the rotational position of the disk 14 and the controller 45 can show any desired expression by designating a particular rotational position of the disk 14.

While the invention has been described in detail and with reference to specific embodiments thereof, it will be apparent to one skilled in the art that various changes and modifications can be made therein without departing from the spirit and scope thereof. Thus, it is intended that the invention covers the modifications and variations of this invention provided they come within the scope of the appended claims and their equivalents.

We claim:

1. An expression-varying device for a toy comprising:

a first facial element; and a drive coupled to said facial element, said drive including a shaft, a disk mounted on said shaft, and an arm member engaged with said disk and coupled to said facial element, rotation of said shaft rotating said disk, which in turn moves said arm member, which imparts movement in a first direction and in a second direction substantially perpendicular to said first direction to said first facial element.

2. The expression-varying device of claim 1, wherein said first facial element is an eyeball body.

3. The expression-varying device of claim 1, wherein said arm member includes a pin, said disk includes a groove formed therein, and said pin engages said groove.

4. The expression-varying device of claim 3, further comprising:

a frame supporting said drive; and a spring coupled to said frame and said arm member to bias said pin into engagement with said groove.

5. The expression-varying device of claim 1, further comprising:

a frame supporting said drive; and a plate coupled to said frame, wherein said plate defines an opening into which a portion of said first facial element extends.

6. The expression-varying device of claim 1, further comprising:

a frame;

a plate coupled to said frame;

a first coupling shaft pivotally mounted with respect to said plate, said first coupling shaft including a tip end and a rear end;

a second facial element coupled to said tip end of said first coupling shaft; and a first crank coupled to said rear end of said first coupling shaft, said first crank engaging said drive, wherein upon rotation of said shaft, said first crank moves and said first coupling shaft pivots, thereby imparting movement to said second facial element.

7. The expression-varying device of claim 6, wherein said drive includes a first cam mounted on said shaft, said first cam having a wave-form surface with projections and indentations formed on a circumferential edge of said first cam, said first crank having a first engaging shaft formed thereon, and said first engaging shaft engages said wave-form surface as said first cam rotates.

8. The expression-varying device of claim 7, further comprising:

a second coupling shaft pivotally mounted with respect to said plate, said second coupling shaft including a tip end and a rear end;

a third facial element coupled to said tip end of said second coupling shaft; and a second crank coupled to said rear end of said second coupling shaft, said second crank engaging a second cam mounted on said shaft, wherein upon rotation of said shaft, said second crank moves and said second coupling shaft pivots, thereby imparting movement to said third facial element.

9. The expression-varying device of claim 8, further comprising:

a spring connected between said first crank and said second crank, wherein said first crank includes a first hook, said second crank includes a second hook, said spring being connected to said first and second hooks, said second crank having a second engaging shaft formed thereon, and said spring biasing said first engaging shaft and said second engaging shaft into engagement with said first cam and said second cam, respectively.

10. The expression-varying device of claim 6, wherein said first facial element is an eyeball body, said second facial element is an eyebrow body, and said eyeball body and said eyebrow body are moved simultaneously.

11. A method of producing multiple expressions in a toy comprising:

moving a first facial element in a first direction, said first facial element being an eyeball body;

moving said first facial element in a second direction, the second direction being substantially perpendicular to the first direction; and moving a second facial element substantially simultaneously with said moving said first facial element in a second direction, said second facial element being an eyebrow body.

12. The method of claim 11, further comprising:

moving said first facial element to a first position;

moving said second facial element to a second position, the first and second facial elements producing a first expression when in said first and second positions, respectively.

13. The method of claim 12, further comprising:

moving said first facial element to a third position; and moving said second facial element to a fourth position, said first and second facial elements producing a second expression when in said third and fourth positions, respectively, said second expression being different from said first expression.

14. The method of claim 13, wherein said moving a first facial element includes moving said first facial element with a drive including a shaft and a disk mounted to said shaft, and said moving said first facial element to a first position and said moving said second facial element to a second position include rotating said disk to a first rotational position.

15. The method of claim 14, wherein said moving said facial element to a third position and said moving said second facial element to a fourth position include rotating said disk to a second rotational position, said second rotational position being different from said first rotational position.

16. The method of claim 15, further comprising:

determining whether said disk is in said second rotational position.

17. The method of claim 15, further comprising:

detecting the rotational position of said disk; and comparing said detected rotational position of said disk with a desired rotational position.

18. The method of claim 11, wherein said moving a first facial element and said moving a second facial element are coordinated to produce at least two of the following expressions: sleeping, sadness, joy, anger, determination, and inquisitiveness.

19. The method of claim 11, wherein said moving a first facial element includes moving said first facial element in an upward and downward motion and moving said first facial element in a side to side motion.

20. An expression-varying device for a toy comprising:

a supporting member pivotally supporting two eyeball bodies for rotation about two substantially perpendicular axes;

a connecting member connecting said two eyeball bodies, said connecting member connecting said eyeball bodies so that said eyeball bodies can pivot simultaneously; and a drive connected to said connecting member and adapted to cause said two eyeball bodies to move in a first direction and in a second direction substantially perpendicular to said first direction to produce various facial expressions for the toy.

21. The device of claim 20, further comprising:

coupling shafts supported by said supporting member, said coupling shafts operably coupled to said drive and mounted for rotation relative to said drive; and eyebrow bodies coupled to each of said coupling shafts and rotated upon the rotation of said coupling shafts.

22. The device of claim 21, wherein said eyeball bodies and said eyebrow bodies move simultaneously.

23. An expression-varying device for a toy comprising:

a first facial element; and a drive coupled to said facial element, said drive including a shaft, a disk mounted on said shaft, and an arm member engaged with said disk and coupled to said facial element, rotation of said shaft rotating said disk, which in turn moves said arm member, which imparts movement in a first direction and in a second direction substantially perpendicular to said first direction to said first facial element, said disk including a center and a groove extending about said center, the distance between said groove and said center varying along said groove, and said groove varying in depth along said groove.

24. An expression-varying device for a toy comprising:

a first facial element;

a drive coupled to said facial element, said drive including a shaft, a disk mounted on said shaft, and an arm member engaged with said disk and coupled to said facial element, rotation of said shaft rotating said disk, which in turn moves said arm member, which imparts movement in a first direction and in a second direction substantially perpendicular to said first direction to said first facial element; and a detection device which detects the rotational position of said disk.

25. The expression-varying device of claim 24, wherein said drive is supported by a frame, and said detection device includes an indicating part formed on the circumferential surface of said disk and a switch mounted on said frame which opens and closes relative to successive indicating parts as said disk rotates.

26. The expression-varying device of claim 1, wherein said disk is configured so that rotation of said disk imparts movement to said first facial element in said first direction and in said second direction substantially simultaneously.

27. The expression-varying device of claim 20, wherein said drive is configured so that said movement of said eyeball bodies in said first direction occurs substantially simultaneously with said movement of said eyeball bodies in said second direction.

28. The expression-varying device of claim 20, wherein said drive includes a shaft and a disk mounted on said shaft, said disk including a center and a groove extending about said center, the distance between said groove and said center varying along said groove, and said groove varying in depth along said groove.

29. The expression-varying device of claim 20, further comprising:

a detection device which detects the rotational position of said disk.

30. The method of claim 11, wherein said moving said first facial element in a first direction occurring substantially simultaneously with said moving said first facial element in a second direction.

31. The method of claim 11, wherein said first facial element and said second facial element are different types of facial elements.

* * * * *